US008708096B2

(12) United States Patent
Bowie

(10) Patent No.: US 8,708,096 B2
(45) Date of Patent: Apr. 29, 2014

(54) METHOD AND MACHINE FOR PRODUCING A SOUND-DEADENING INSERT FOR SILENCER OF AN EXHAUST-GAS DISCHARGE SYSTEM OF AN INTERNAL-COMBUSTION ENGINE

(71) Applicant: SO.LA.IS—Societa' Lavorazione Isolanti—S.r.l. Con Unico Socio, Refrontolo (IT)

(72) Inventor: Juan Martin Bowie, Dublin (IE)

(73) Assignee: SO.LA.IS—Societa' Lavorazione Isolanti S.R.L. Con Unico Socio, Refrontolo (IT)

( * ) Notice: Subject to any disclaimer, the term of this patent is extended or adjusted under 35 U.S.C. 154(b) by 0 days.

(21) Appl. No.: 13/706,606

(22) Filed: Dec. 6, 2012

(65) Prior Publication Data

US 2013/0146392 A1 Jun. 13, 2013

(30) Foreign Application Priority Data

Dec. 7, 2011 (EP) ..... 11192496

(51) Int. Cl.
*E04B 1/82* (2006.01)

(52) U.S. Cl.
USPC ..... 181/286; 181/227

(58) Field of Classification Search
USPC ..... 181/227, 286
See application file for complete search history.

(56) References Cited

U.S. PATENT DOCUMENTS

| | | | | |
|---|---|---|---|---|
| 6,258,739 | B1 * | 7/2001 | Meng et al. | 442/402 |
| 7,509,714 | B2 * | 3/2009 | Rocher et al. | 28/114 |
| 2005/0001012 | A1 * | 1/2005 | Brandt et al. | 228/101 |
| 2006/0278329 | A1 * | 12/2006 | Anderson et al. | 156/169 |
| 2009/0272600 | A1 * | 11/2009 | Okabe et al. | 181/227 |
| 2010/0084219 | A1 * | 4/2010 | Troeger | 181/256 |

FOREIGN PATENT DOCUMENTS

| | | |
|---|---|---|
| EP | 1 055 760 | 11/2000 |
| EP | 1861592 | 3/2010 |
| WO | 2012/113866 | 8/2012 |
| WO | 2012/113867 | 8/2012 |

* cited by examiner

*Primary Examiner* — Forrest M Phillips
(74) *Attorney, Agent, or Firm* — Gottlieb, Rackman & Reisman, P.C.

(57) ABSTRACT

A method for producing a sound-deadening insert of a silencer of an exhaust-gas discharge system in an internal-combustion engine of a vehicle; the method comprises the steps of providing a mattress made up of continuous voluminized fibers of sound-deadening material, and needling the mattress so as to cause a compacting/interweaving of the fibers in order to obtain compacting lines.

12 Claims, 5 Drawing Sheets

METHOD AND MACHINE FOR PRODUCING A SOUND-DEADENING INSERT FOR SILENCER OF AN EXHAUST-GAS DISCHARGE SYSTEM OF AN INTERNAL-COMBUSTION ENGINE

The present invention relates to a method and to a machine for producing a sound-deadening insert that can be installed in a silencer of an exhaust-gas discharge system of an internal-combustion engine of a vehicle, such as for example a motor vehicle, to which the ensuing treatment will make explicit reference without this implying any loss of generality.

BACKGROUND OF THE INVENTION

As is known, silencers of exhaust systems of motor vehicles define a stretch of the exhaust path along which the noise produced by the pressure waves of the exhaust gases emitted by the engine is attenuated. The silencer typically comprises an outer metal containment, shell or casing, one or more metal ducts and/or diaphragms set within the casing, and traversed, in use, by the exhaust gases, and an insert made of sound-deadening material, typically mineral fibres, which is set in the free cavities of the casing in such a way as to fill the internal space thereof and coat/envelop the ducts and/or diaphragms so as to attenuate the transmission of the noise generated by the gases outwards.

Some types of silencers sound-deadening inserts comprise fibreglass mattresses, which are obtained through methods that basically envisage winding one or more fibreglass threads around a tubular element so as to obtain a tubular skein, flattening the skein of fibres so as to obtain the mattress of reduced thickness, and making stitches using thread on the fibreglass mattress so as to prevent the mattress from opening up when it is being installed inside the silencer casing.

Making stitches using thread on the fibreglass mattress envisaged in the methods described above, even though effective, is particularly inconvenient in so far as it has a major effect on the overall times and costs necessary for producing the insert.

The present applicant has consequently conducted an in-depth study having the purpose of identifying a solution that would specifically enable the aim to be achieved of providing a method and a machine for producing an insert, made of sound-deadening material that is without stitches, but presents a certain degree of compactness, and is consequently not subject to opening when it is being moved and in the course of its installation in the casing of the silencer.

SUMMARY OF THE INVENTION

The object of the present invention is to provide a solution that will enable the aim referred to above to be achieved.

The above object is achieved by the present invention in so far as it relates to a method for producing a sound-deadening insert structured to be installed in a silencer of a system for discharge of the exhaust gases emitted by an internal-combustion engine, as defined in the annexed claims.

The present invention moreover regards a sound-deadening insert needling machine configured to producing a sound-deadening insert installable in a silencer of a system for discharge of the exhaust gases emitted by an internal-combustion engine, as defined in the annexed claims.

The present invention moreover relates to a sound-deadening insert structured to be installed in a silencer of a system for discharge of the exhaust gases emitted by an internal-combustion engine, as defined in the annexed claims.

The present invention moreover regards the use of a sound-deadening insert in a silencer of a system for discharge of the exhaust gases emitted by an internal-combustion engine, as defined in the annexed claims.

BRIEF DESCRIPTION OF THE DRAWINGS

The present invention will now be described with reference to the annexed drawings, which illustrate a non-limiting example of embodiment thereof and in which.

DETAILED DESCRIPTION OF THE INVENTION

The present invention will now be described in detail with reference to the attached figures to enable a person skilled in the sector to reproduce it and use it. Various modifications to the embodiments described will be immediately evident to persons skilled in the sector, and the generic principles described can be applied to other embodiments and applications, without thereby departing from the sphere of protection of the present invention, as defined in the annexed claims. Consequently, the present invention is not to be considered limited to the embodiments described and illustrated, but it must be granted the widest sphere of protection in conformance with the principles and characteristics described and claimed herein.

Figure 1:
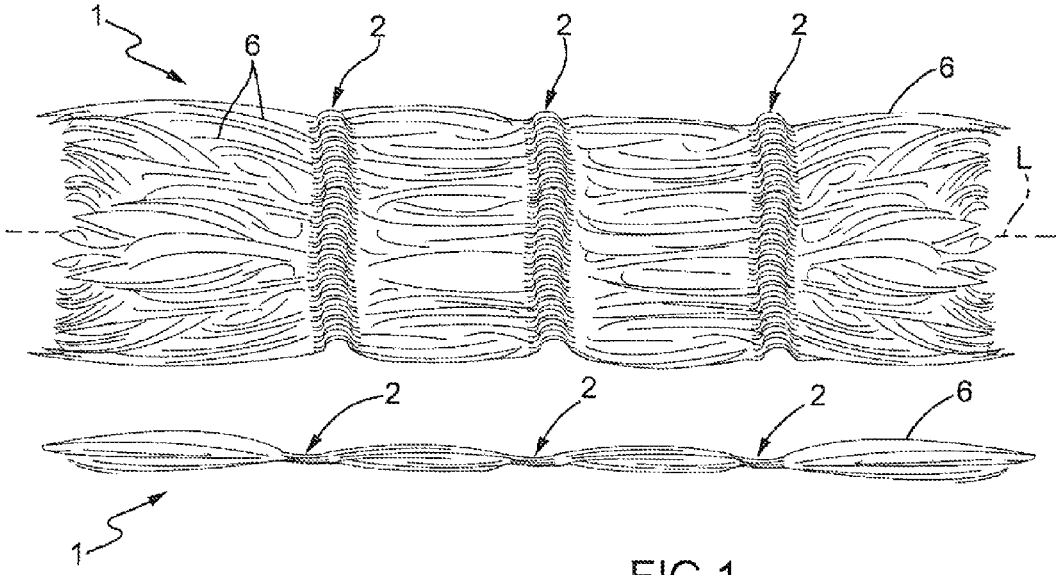
FIG. 1 represents schematically a top plan view and a view in side elevation of a sound-deadening insert obtained according to the teachings of the present invention.

With reference to FIG. 1, designated as a whole by the number 1 is a sound-deadening insert obtained through the needling method/machine provided/built according to the teachings of the present invention, which can be installed in an exhaust-gas discharge system of an internal-combustion engine of a vehicle (not illustrated).

According to a preferred embodiment, the sound-deadening insert 1 comprises a substantially plane and flexible mattress preferably, but not necessarily, having a rectangular shape, which develops along a longitudinal axis L. As will be clarified in detail hereinafter, the sound-deadening insert 1 is formed by a plurality of turns of continuous sound-deadening mineral fibre that develop in a direction substantially parallel to the longitudinal axis L so that they are coaxial with an axis orthogonal to the longitudinal axis L itself. The turns forming the body of the insert are squeezed/pressed on two opposite sides so that the sound-deadening insert 1 is flattened on said sides.

The sound-deadening insert 1 moreover has one or more compacting stretches/lines 2 where the continuous fibres are compacted (only three of said stretches are illustrated purely by way of example in FIG. 1), which extend substantially transverse to the continuous fibres that make up the turns, i.e., transverse to the longitudinal axis L, and are provided for keeping the mineral fibres locally joined/compacted together so as to prevent the plane mattress from opening up.

As will be clarified in detail hereinafter, unlike the known solutions, each compacting line 2 of compacted fibres of the sound-deadening insert 1 produced according to the teachings of the present invention is obtained by carrying out a localized needling of the mattress in a direction transverse to the axis L.

Figure 9:
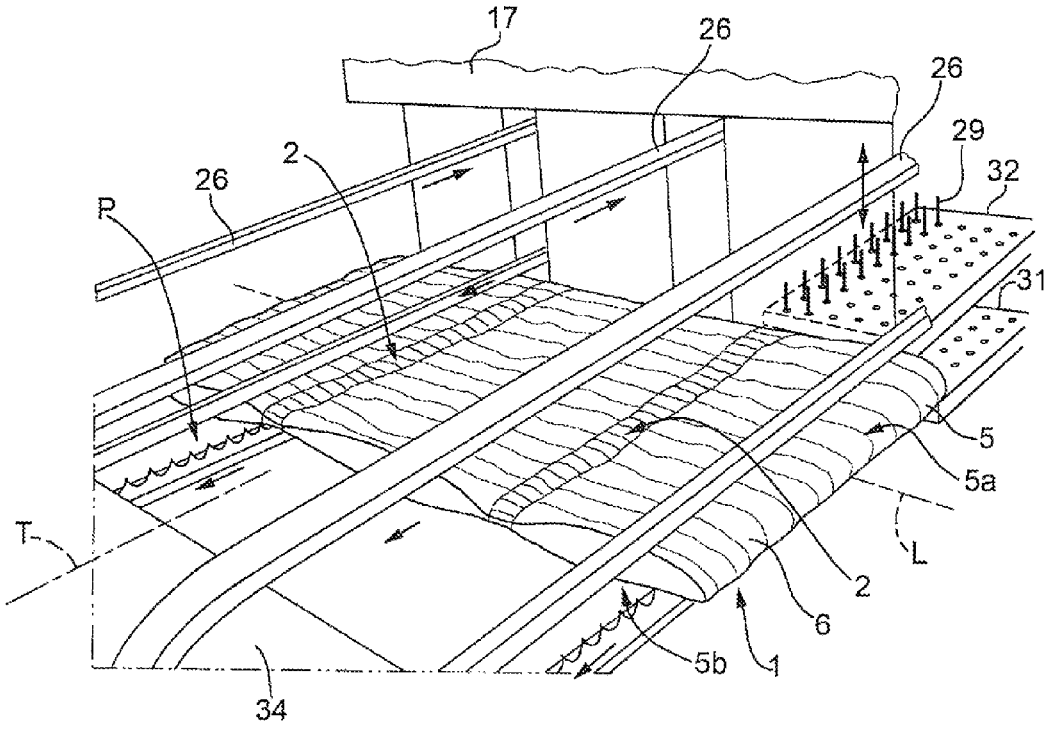
Figure 10:
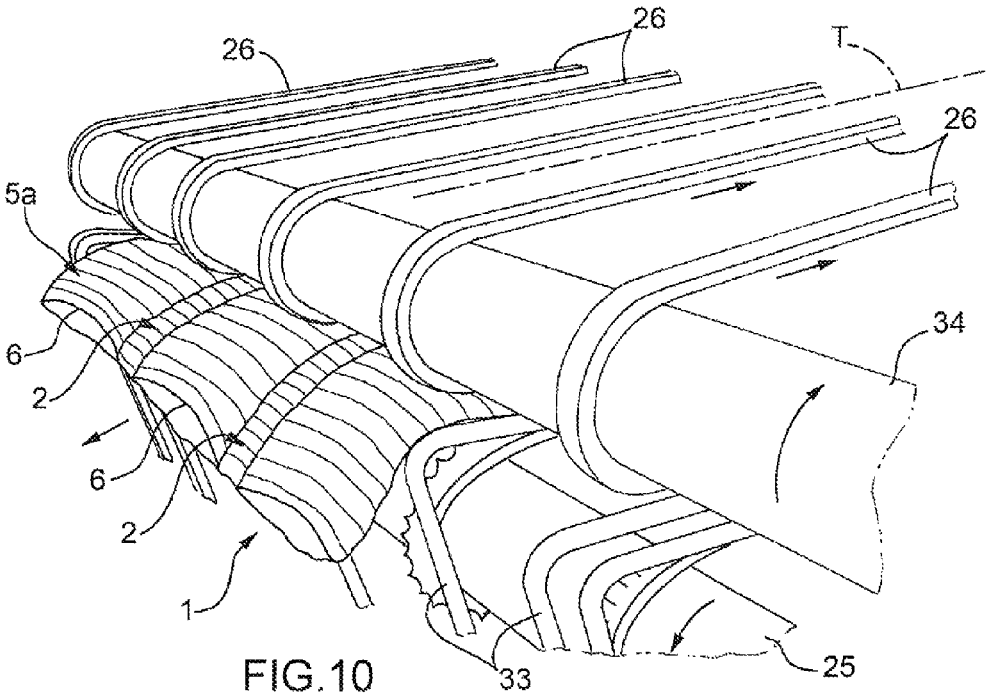

With reference to FIGS. 2, 7, 8, 9 and 10, the method provided by the present invention basically envisages producing the sound-deadening insert 1 through the following steps: winding a voluminized web/strip 3 of continuous voluminized sound-deadening mineral fibre about a winding axis A in such a way as to obtain a tubular reel or skein 4 (FIG. 2), the turns of which are coaxial axis A and develop parallel to the longitudinal axis L; squeezing/compressing the tubular reel or skein 4 on two opposite sides in such a way as to flatten it so as to obtain a substantially plane mattress 5 forming the body of the sound-deadening insert 1 and having two larger surfaces 5*a*, 5*b* opposite and parallel to one another (FIG. 8); and carrying out needling on the two larger surfaces 5*a* and 5*b* of the mattress 5 to interweave/superimpose the continuous fibres 6 so as to compact the mattress 5 along the compacting lines 2 and thus obtain the sound-deadening insert 1 (FIGS. 9 and 10).

According to a preferred embodiment, needling is obtained along substantially rectilinear compacting lines 2 of the mattress 5 having the shape of strips of a small width that extend parallel to one another and transverse to the direction of development and winding of the continuous fibres 6 of the mattress 5.

According to the preferred embodiment, the continuous fibres 6 can advantageously comprise continuous glass fibres, or basalt fibres, or silica fibres, or any other type of similar mineral fibre having sound-deadening properties.

According to a different embodiment, the fibres 6 can conveniently comprise continuous fibres of polystyrene-based and/or polypropylene-based and/or polyamide-based material of a synthetic type and/or any other type of similar synthetic sound-deadening material.

According to the preferred embodiment (not illustrated), the compacting lines 2 are set parallel to, and at pre-set distances from, one another.

According to a different embodiment (not illustrated), the compacting lines 2 are set in adjacent positions alongside one another in such a way as to obtain a compacting area having a pre-set width measured along the axis L.

With reference to FIGS. 2-6, the operations of the method for producing the sound-deadening insert 1 described above can be advantageously performed using: a spooling machine 8 (illustrated in FIG. 2) structured for winding the voluminized strip 3 about the winding axis A so as to provide a plurality of turns forming the tubular skein 4; and a needling machine 9 (illustrated in FIGS. 3, 4, 5, and 6), which is structured for exerting a compression/squeezing on the two opposite surfaces of the tubular skein 4 in such a way as to flatten it so as to obtain the mattress 5, and is able to needle the mattress 5 itself so as to form the compacting stretches/lines 2 in order to obtain the finished sound-deadening insert 1 illustrated in FIG. 1.

Figure 2:
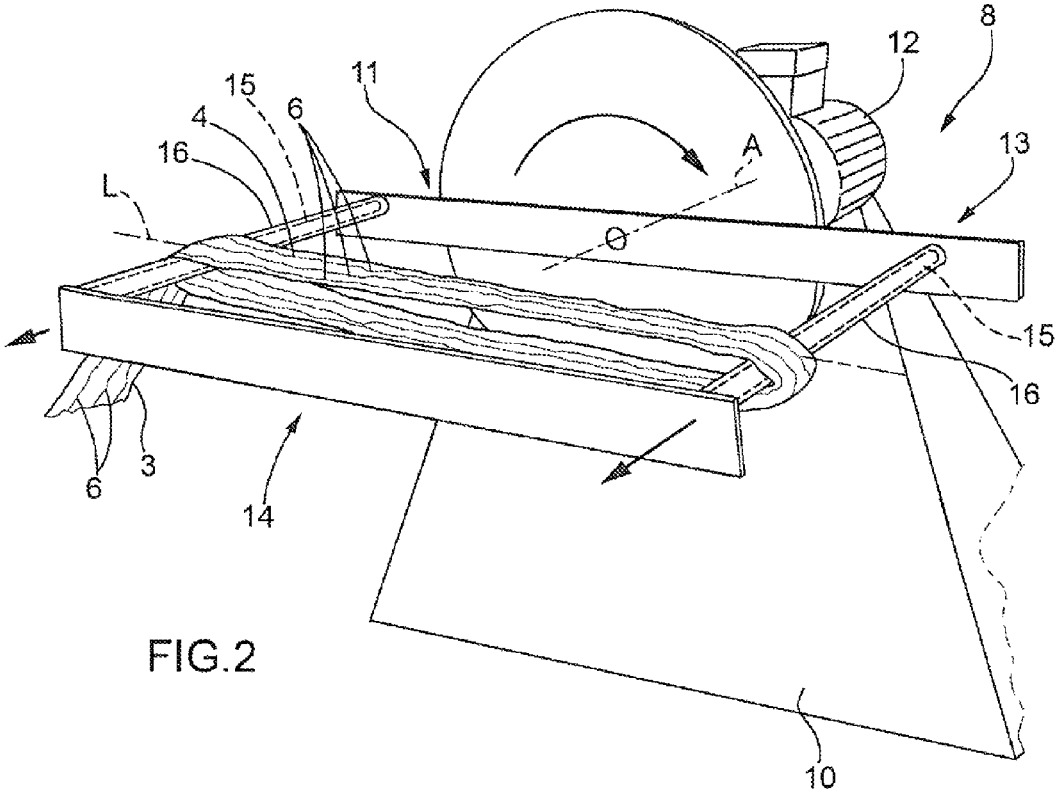
FIG. 2 is a schematic perspective view of a spooling machine used for performing a step of the method for producing a sound-deadening insert according to teachings of the present invention.
Figure 3:
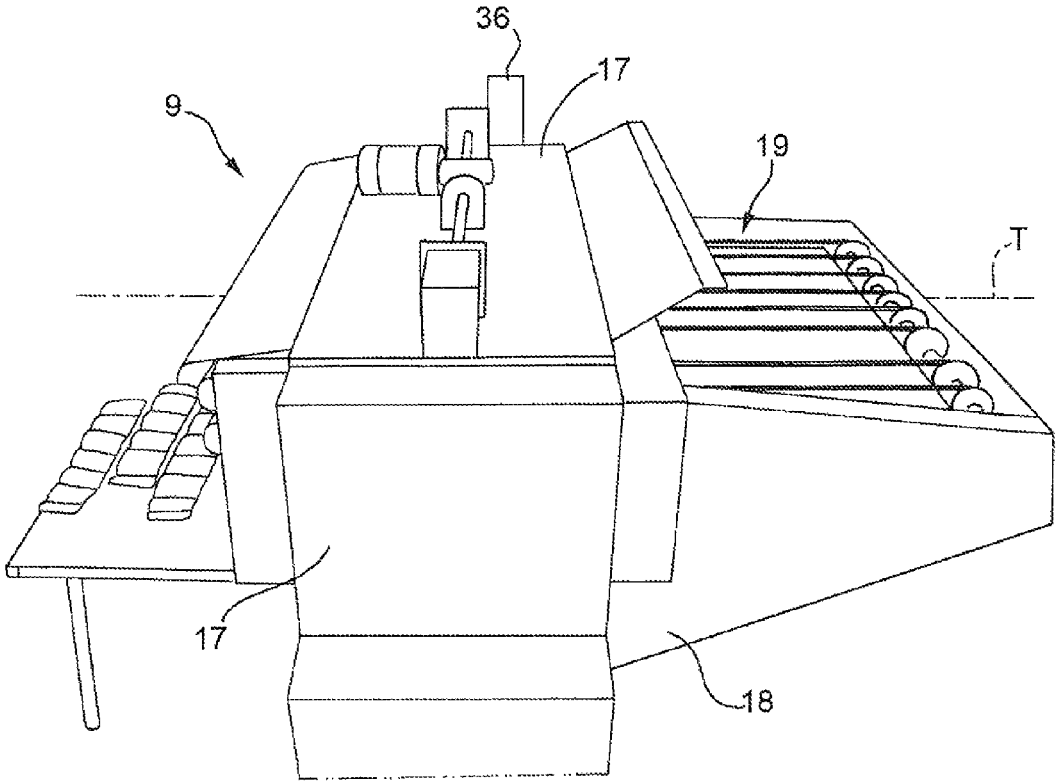
FIG. 3 is a schematic perspective view of a needling machine used for performing a series of operations of the method for producing a sound-deadening insert according to teachings of the present invention.

According to a preferred embodiment illustrated in FIG. 2, the spooling machine 8 comprises: a supporting base 10 resting on the ground; a rotating forming frame 11, which performs the function of spinning wheel for winding the continuous fibres 6 of the voluminized strip 3 so as to form the tubular skein 4 and is designed to be driven in rotation about the winding axis A by the output shaft (not illustrated) of a drive unit 12, for example an electric motor appropriately set/fixed on/to the supporting base 10.

In the example illustrated in FIG. 2, the rotating forming frame 11 has a substantially rectangular shape and comprises a supporting fork 13, rigidly connected to the output shaft of the drive unit 12, and a removable forming fork 14, which is designed to be coupled in a stable, but easily removable, way to the supporting fork 13, to enable convenient removal of the tubular skein 4 from the spooling machine 8.

Figure 7:
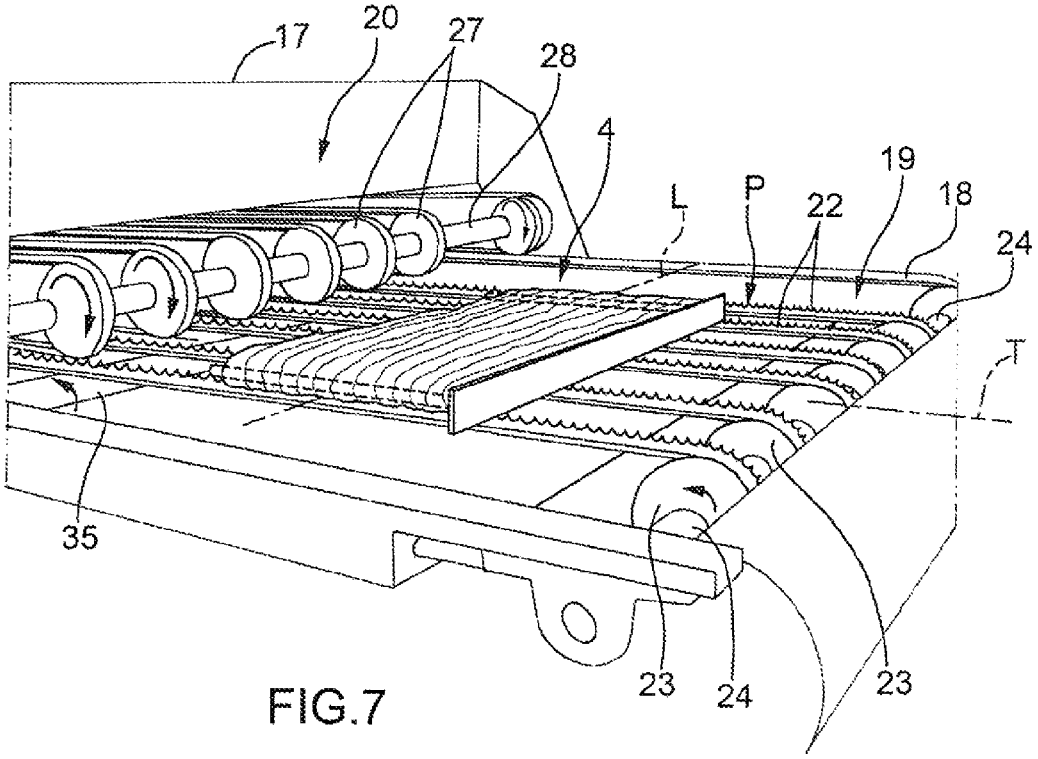
FIGS. 7 to 10 show as many steps of the method provided according to teachings of the present invention.
Figure 8:
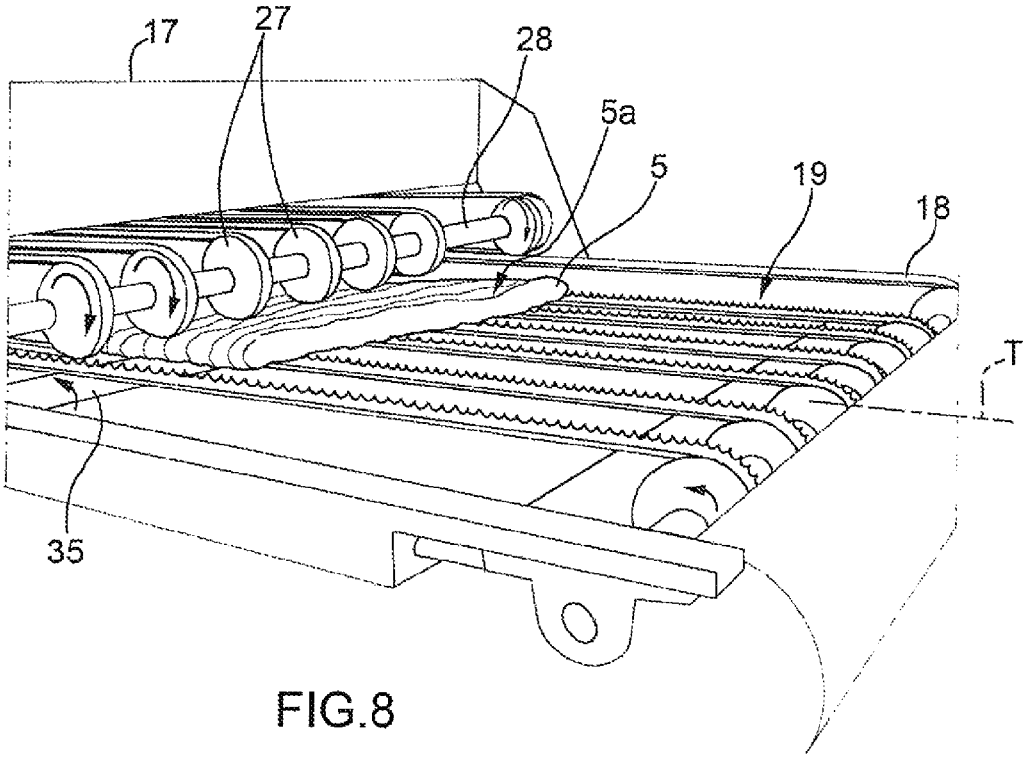

According to the preferred embodiment illustrated in FIG. 2, the supporting fork 13 comprises a bar fixed at the centre to a rotating disk rigidly connected to the output shaft of the drive unit 12, and at least two supporting arms or rods 15, which extend in cantilever fashion from the distal ends of the bar in directions parallel to one another and to the axis A and are set at a pre-set distance from one another substantially corresponding to the length of the mattress 5 measured along the longitudinal axis L. Fitted on the two supporting rods 15 of the supporting fork 13 are two tubular arms 16 of the removable forming fork 14, which extend parallel to the axis A and are joined together by a supporting bar transverse to the axis L. In use, winding of the fibres 6 is performed around the tubular arms 16 of the removable forming fork 14, which, at the end of formation of the tubular skein 4, can be conveniently slid out/uncoupled from the supporting fork 13 keeping the tubular skein 4 compact and wound around the tubular arms 16 themselves so as to enable a convenient displacement of the latter towards the needling machine 9 (as illustrated in the example of FIG. 7).

With reference to FIGS. 3-6, the needling machine 9 comprises: a supporting frame 18 resting on the ground; a plane conveyor 19, which is supported at the top by the supporting frame 18, has a longitudinal axis T, and is designed to feed the tubular skein 4 along the longitudinal axis T keeping it locally on a preferably horizontal resting surface P; a pressing assembly 20, which is supported by a portal structure 17 connected to the sides of the supporting frame 18 in such a way as to be set above the resting surface F, and is structured for cooperating with the underlying plane conveyor 19 so as to exert on the tubular skein 4, during feed of the latter, a pressure/squeezing action on the two opposite sides parallel to the plane of the resting surface P to cause the thickness of the tubular skein 4 to be reduced to a pre-set thickness so as to form the mattress 5.

Figure 6:
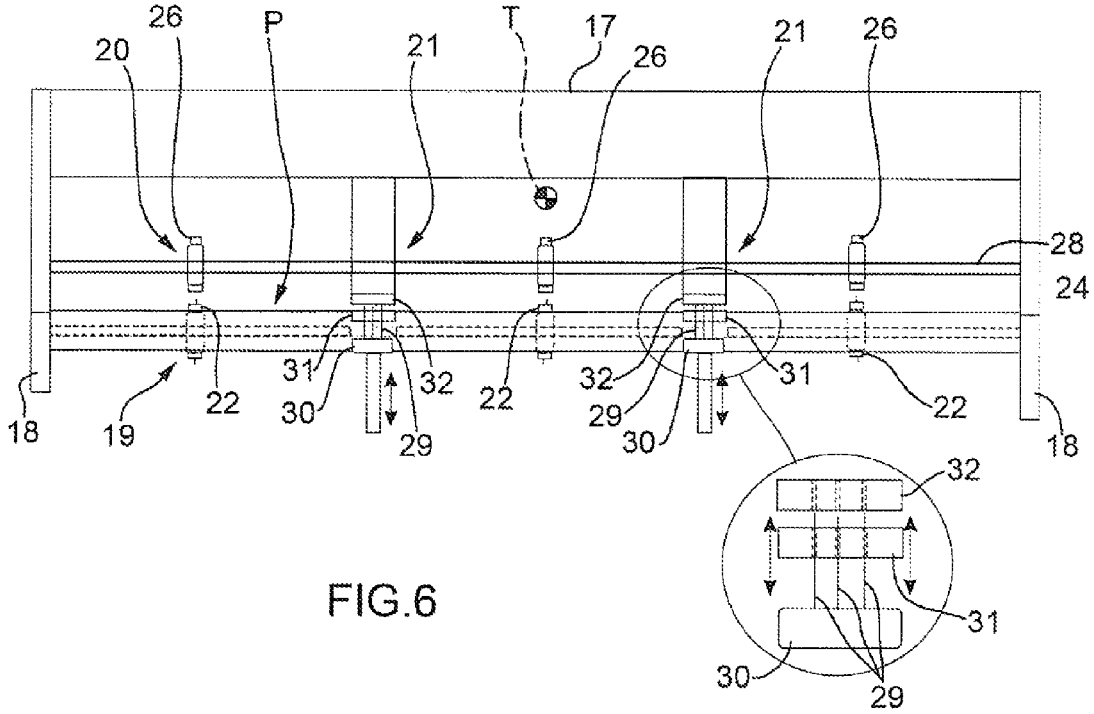
FIG. 6 is a schematic view in front elevation of a needling member of the needling machine illustrated in FIG. 3; whilst

With reference to FIG. 6, the needling machine 9 moreover comprises one or more needling members 21, which are set downstream of the pressing assembly 20 in the direction of feed of the tubular skein 4, and are designed for carrying out localized needling on the larger surfaces 5*a*, 5*b* of the mattress 5 so as to obtain respective lines/stretches 2 where the continuous fibres 6 are compacted.

Figure 4:
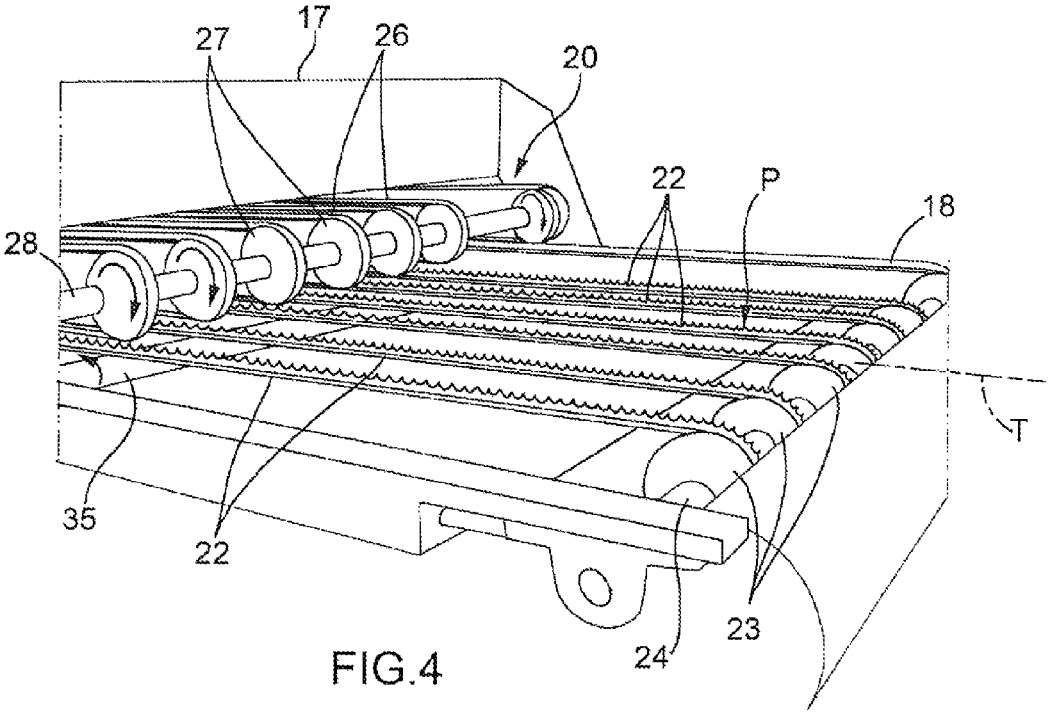
FIG. 4 is a perspective view of the inlet portion of the surface of feed of the needling machine illustrated in FIG. 3.
Figure 5:
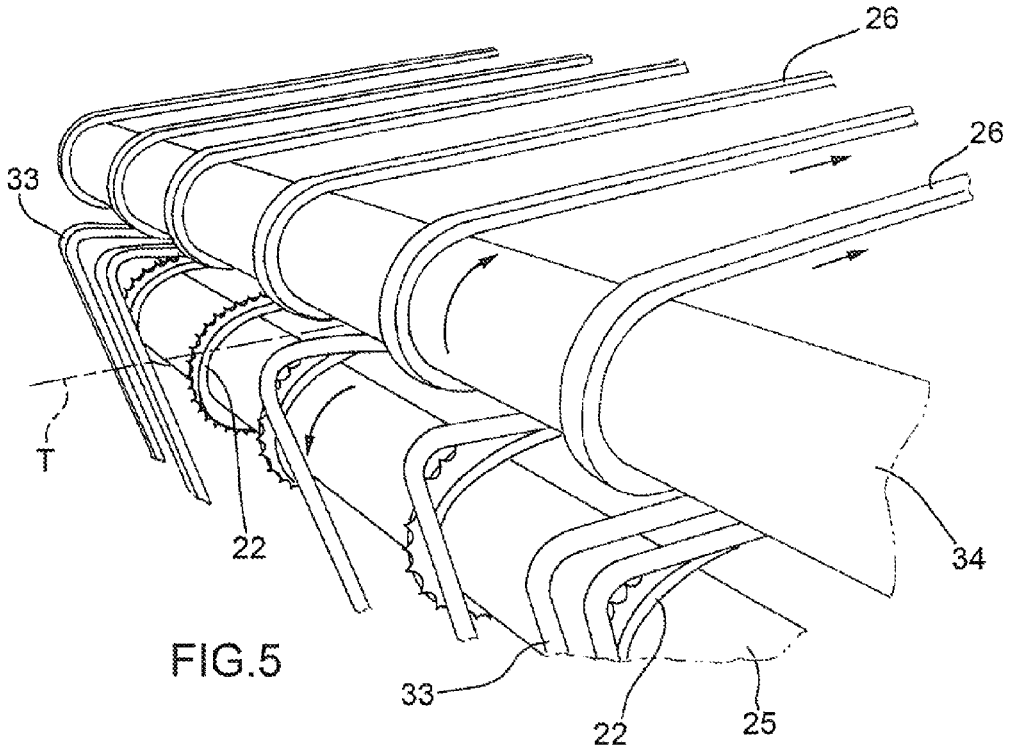
FIG. 5 is a perspective view of the outlet portion of the surface of feed of the needling machine illustrated in FIG. 3.

With reference to FIG. 4, the plane conveyor 19 comprises at least one pair of cogged conveyor belts 22 (six are illustrated by way of example in FIG. 4), which extend parallel to one another and to the longitudinal axis T at a pre-set distance from one another smaller than or equal to the length of the mattress 5 and are each wound, at their own ends, around a pulley 23 fitted on a corresponding shaft for transmission of motion 24, and around a driving roller 25 (illustrated in FIG. 5).

The shaft for transmission of motion 24 and the driving roller 25 are both set orthogonal to the longitudinal axis T, are fitted with the respective ends on the longitudinal sides of the supporting frame 18 and are designed to be driven in rotation around the corresponding axes of rotation by drive units (not illustrated), for example electric motors, via mechanisms for transmission of motion that are known and are consequently not described in detail herein.

As regards the pressing member 20, it comprises at least one pair of presser belts 26 (seven of which are illustrated by way of example in FIG. 4), which are supported by the portal structure 17 through pulleys and rotating rollers, extend parallel to one another and to the longitudinal axis T, and are set above the cogged conveyor belts 22 so that each bottom branch of a presser belt 26 is parallel to and faces the resting surface P and the plane conveyor 19.

In the example illustrated, the presser belts 26 and the cogged conveyor belts 22 lie in pairs on parallel but non-coinciding vertical surfaces and are preferably fed in a synchronised way at one and the same speed of advance so that during feed of the tubular skein 4, the latter is Pressed/squeezed between the bottom branch of the presser belt 26 and the top branch of the cogged conveyor belt 22. However, according to a different embodiment, the cogged conveyor belts 22 can be set in pairs in one and the same vertical plane in such a way as to be coplanar.

In the example illustrated in FIG. 4, the plane conveyor 19 comprises a central contrast roller 35, which extends orthogonal to the longitudinal axis T between the two, top and bottom, branches of the cogged conveyor belts 22 so as to be set underneath the pressing assembly 20, and has the function of preventing the top branch of each cogged conveyor belt 22 from shifting underneath the plane of the resting surface P when the presser belt 26 exerts compression on the top surface 5*a* of the mattress 5 downwards. In particular, the central contrast roller 35 is mounted idle on the two longitudinal sides of the supporting frame 18 and is designed to support the cogged conveyor belts 22 at the centre so as to keep the corresponding top branches substantially in the plane of the resting surface P.

Preferably, one end of each presser belt 26 is wound around a pulley 27, which is in turn fitted on a rotating shaft 28 connected to the two longitudinal sides of the portal structure 17 through bearings or similar systems in such a way as to be locally parallel to the resting surface P and orthogonal to the longitudinal axis T, whilst the opposite end of each presser belt 26 is wound around a driving roller 34 orthogonal to the longitudinal axis T and set parallel to and facing the driving roller 25 above the latter. In the example illustrated, the rotating shaft 28 and the driving roller 34 are driven in rotation by drive units (not illustrated), for example electric motors, via mechanisms for transmission motion that are of a known type and are consequently not described in detail herein. The distance of the presser belts from the respective cogged conveyor belts 22 can be appropriately regulated through actuator devices (not illustrated) appropriately set between the supporting frame 18 and the portal structure 17.

With reference to FIG. 6, each needling member 21 is set between two consecutive adjacent cogged conveyor belts 22 in such a way as to provide the compacted continuous fibres lines on a surface portion of the mattress 5 external to the surfaces pressed by the presser belts 26.

Preferably, each needling member 21 comprises a plurality of preferably vertical needles 29 set in rows parallel to the longitudinal axis T and is structured for moving the needles 29 according to a reciprocating vertical motion away from and towards the mattress 5, so that the needles 29 themselves traverse the mattress 5 and draw, during their traversal, the fibres vertically in a reciprocating way so as to obtain a localized superposition/cohesion thereof, thus causing a localized compacting of the mattress 5.

In the example illustrated in FIG. 6, each needling member 21 comprises: a needle-holder plate 30 comprising the needles 29 set so as to form parallel rows and each present the bottom end stably coupled to the top face of a needle-holder plate 30 and the top end, i.e., the tip, serrated or hook-shaped; a first perforated plate or stripper plate 31 rigidly connected to the supporting frame 18 in such a way as to be set locally coplanar to the resting surface P immediately above the needle-holder plate 30 so as to support the mattress 5 locally on the resting surface P during needling and be able to prevent the needles 29 from drawing along the fibres 6 during the vertical descending motion; and a second perforated plate or needling plate 32, which is rigidly connected to the portal structure 17 in such a way as to be set above the resting surface P parallel thereto and facing/vertically aligned to both the underlying stripper plate 31 and the needle-holder plate 30.

In the example illustrated, the needle-holder plate 30 supports three vertical rows of needles 29 and is designed to be displaced vertically according to the vertical reciprocating motion away from and towards the stripper plate 31, preferably remaining parallel thereto so as to cause the needles 29 to penetrate into the through holes of the stripper plate 31 and into the through holes of the needling plate 32.

Preferably, the needling machine 9 can be provided with an electromechanical system (not illustrated) structured to impart upon the needle-holder plate 30 the vertical reciprocating motion in a way synchronised with the displacements imparted on the mattress 5 by the plane conveyor 19. In the case in point, the electromechanical system is configured to cause, when the plane Conveyor 19 feeds the mattress 5 along the axis T, the needle-holder plate 30 to be completely lowered so as to prevent the needles 29 from interfering with the fibres of the mattress 5 and thus enable the latter to slide freely over the top surface of the stripper plate 31.

In order to adjust the transverse position and/or vertical position of each needling member 21, and/or the depth of penetration of the needles 29 in the mattress 5, the needling machine 9 can be provided with actuator devices (not illustrated) appropriately arranged in the supporting frame 18 and/or in the portal structure 17, which are controlled by an electronic control unit 36.

It should be pointed out that the transverse displacement of each needling member 21 can be performed manually through known mechanical fixing means designed to fix a supporting element of the needling member 21 to the machine, for example to the portal structure 17 and/or to the supporting frame 18.

The electronic control unit 36 can moreover be configured for controlling the drive unit of the plane conveyor 19, the pressing assembly 22, and the electromechanical system so as to adjust the speed of feed of the tubular skein 4, the speed of squeezing, and the speed of vertical movement of the needles 29.

With reference to FIGS. 5 and 10, the needling machine 9 moreover has, at the end of each cogged conveyor belt 22 that is run over the driving roller 25, a chute 33, which is shaped in such a way as to raise and hence separate, during feed of the sound-deadening insert 1 along the axis T, the bottom surface of the insert itself from each cogged conveyor belt 22 so as to prevent the cogs of the latter from tearing the fibres 6. In the preferred embodiment illustrated in FIG. 5, the chute 33 comprises two parallel, preferably tubular, metal rods, which are set on opposite sides of the cogged conveyor belt 22 so as to enable the cogs to slide alongside the rods themselves, are bent to form an L shape in such a way as to present a horizontal stretch that is slightly inclined with respect to the resting surface P and a vertical stretch for connection to the supporting frame 18 through a horizontal supporting bar (not illustrated).

Preferably, the inclined horizontal stretch has a first end substantially set in the plane of the resting surface P so as to be able to receive the sound-deadening insert 1 and a second end raised with respect to the cogged conveyor belt 22 so as to cause raising of the sound-deadening insert 1 with respect to the resting surface P and hence with respect to the cogged conveyor belt 22 during sliding/feed of the sound-deadening insert over the metal rods.

Given what has been described above, it should be pointed out that the voluminization of the strip 3 can be obtained through execution of the following steps: running off one or more threads of mineral fibre from a series of winding spools or reels and grouping and/or twisting the threads together in such a way as to obtain at least one cord of a pre-set length, calculated on the basis of the weight of the sound-deadening insert 1 to be produced; and texturizing the cord in such a way as to obtain the continuous strip/web 3 of voluminized fibre. Preferably, voluminization of the cord can be obtained using an air-jet texturizer machine (not illustrated), which, since it is of a known type, will not be described any further herein other than to point out that it is provided with at least one nozzle supplied by a pressurized jet of air, which is structured for being traversed by the cord. When the cord is slid through the nozzle, the fibres thereof assume, as a result of the internal turbulence created by the air supplied in the nozzle itself, a disorderly and voluminous structure that transforms the compact cord into a texturized web.

With reference to FIG. 7, following upon production of the tubular skein 4 (illustrated in FIG. 2), the removable forming fork 14 is slid out of the supporting fork 1.3 so as to convey and, bring the tubular skein 4 to rest on the cogged conveyor belts 22 of the needling machine 9. In the case in point, there can be envisaged movement means, for example a robot, controlled by the electronic control unit 36 in such a way as to execute the operations described above for sliding out the removable forming fork 14 so as to position the tubular skein 4 on the cogged conveyor belts 22.

With reference to FIG. 7, the electronic control unit 36 controls the cogged conveyor belts 22 so as to feed the tubular skein 4 along the longitudinal axis T in the direction of feed towards the presser belts 26, which co-operate with the cogged conveyor belts 22 in order to flatten out the tubular skein 4 on the two opposite sides so as to form the plane mattress 5.

The electronic control unit 26 controls the cogged conveyor belts 22 so as to feed the plane mattress 5 also through the needling members 21, which, during feeding, carry cut localized needling on the mattress 5 so as to form the rectilinear compacting stretches 2.

Finally, the cogged conveyor belts 22 feed the needled mattress 5 towards the chute 33, which raises the mattress 5 itself from the cogs of the cogged conveyor belts 22 so as to discharge it outside the needling machine 9.

The method and the needling machine present the advantage of providing in a simple and economically advantageous way an extremely compact insert made of sound-deadening material, without the need to perform operations of stitching thereon.

Finally, it is clear that modifications and variations may be made to the machine, method, and sound-deadening insert described above, without thereby departing from the scope of the present invention as defined in the annexed claims.

The invention claimed is:

1. A method for producing a sound-deadening insert (1) of a silencer of an exhaust-gas discharge system in an internal-combustion engine of a vehicle; the method being characterized in that it comprises the steps of:

providing a flexible mattress (5) comprising continuous voluminized fibres (6) of sound-deadening material having a plurality of turns arranged coaxial to each other, the fibres being wound around a winding axis (A); and carrying out one or more needling operations on the mattress (5) within, respectively, one or more pre-set surface strips of the mattress (5) itself in such a way as to interweave the continuous fibres (6) locally so as to obtain, respectively, one or more compacting lines (2) of compacted fibres (6), each of which extends without interruption along said mattress (5) in a direction transverse to the continuous fibres (6) and keeps the continuous fibres (6) joined together locally so as to prevent the mattress (5) from opening up.

2. The method according to claim 1, wherein the step of providing a mattress (5) comprising the steps of:

winding a voluminized strip (3) comprising said continuous voluminized fibres (6) around said winding axis (A) in such a way as to obtain a tubular skein (4); and compressing the tubular skein (4) on two opposite sides in such a way as to flatten it out.

3. The method according to claim 2, comprising the steps of:

winding said voluminized web (3) around tubular arms (16) of a forming fork (14), which are coupled in a stable, but easily removable, way to respective supporting arms (15) of a supporting fork (13), which are designed to turn about said winding axis (A); and at the end of formation of said tubular skein (4), uncoupling said forming fork (14) from said supporting fork (13) keeping said tubular skein (4) wound around the tubular arms (16) of said forming fork (14).

4. The method according to claim 1, which envisages: one or more needling members (21); a resting surface (P) on which the tubular skein (4) rests; and conveyor means (19) designed to feed said tubular skein (4) on said resting surface (P) along a horizontal axis of feed (T) so as to traverse said needling members (21); said method comprising the step of displacing at least one needling member (21) in a direction transverse to said axis of feed (T) so as to align the needling member (21) itself with a corresponding pre-set surface strip of the mattress (5) on which the compacting lines (2) of compacted fibres (6) is obtained.

5. The method according to claim 4, comprising the step of synchronizing the motion of feed imparted on the mattress (5) by said conveyor means (19) along said axis of feed (T) with the reciprocating vertical motion of the needles (29) of said needling members (21).

6. A sound-deadening insert needling machine (9) configured to provide a sound-deadening insert (1) for a silencer of an exhaust-gas discharge system in an internal-combustion engine of a vehicle:

said needling machine (9) being characterized in that it comprises:

conveyor means (19), which are structured to receive at least one flexible mattress (5) on a resting surface (P) and displacing the mattress (5) keeping it on said resting surface (P) along an pre-set axis of feed (T); said mattress (5) comprising continuous voluminized fibres (6) of sound-deadening material having a plurality of turns arranged coaxial to each other, said fibres being wound around a winding axis (A);

one or more needling members (21), which are structured to carry out one or more needling operations on the mattress (5) during its advance along said axis of feed (T), within, respectively, one or more pre-set surface strips of the mattress (5) itself in such a way as to interweave the continuous fibres (6) locally so as to obtain, respectively, one or more lines (2) of compacted fibres (6), each of which extends without interruption along said mattress (5) in a direction transverse to the continuous fibres (6) and keeps the continuous fibres (6) joined together locally so as to prevent the mattress (5) from opening up.

7. The needling machine according to claim 6, wherein each needling member (21) comprises a plurality of needles (29), is structured for moving the needles (29) according to a reciprocating motion away from and towards the mattress (5) in a direction transverse to the axis of feed (T) thereof, and is sized so that the corresponding needles (29) traverse the mattress (5) locally remaining in the internal space delimited by a corresponding surface strip of the mattress (5).

8. The needling machine according to claim 6, comprising pressing means (20) structured for co-operating with said conveyor means (19) in such a way as to exert on a tubular skein (4) made up of said continuous voluminized fibres (6), during feed of the tubular skein (4), a pressure action on the two opposite sides parallel to said resting surface (P) to cause the thickness of the tubular skein (4) to be reduced to a pre-set thickness so as to form the mattress (5).

9. The needling machine according to claim 8, comprising means for displacing at least one needling member (21) in a direction transverse to said axis of feed (T) so as to align it to a corresponding pre-set surface strip of the mattress (5) on which the stretch (2) of compacted fibres (6) is obtained.

10. The needling machine according to claim 9, comprising electronic control means configured to synchronize the motion of feed imparted by said conveyor means (19) on the mattress (5) with the reciprocating vertical movement of the needles (29) of said needling members (21).

11. A silencer sound-deadening insert (1) of an exhaust-gas discharge system in an internal-combustion engine of a vehicle; said silencer sound-deadening insert (1) comprising a flexible mattress (5) made up of continuous voluminized fibres (6) of sound-deadening material having a plurality of turns arranged coaxial to each other, the fibres being wound around a winding axis (A) and having one or more needled lines (2) of compacted fibres (6) that extend without interruption along the mattress (5) transverse to said fibres (6) and are designed to keep the fibres (6) locally joined together so as to prevent the mattress (5) from opening up.

12. Use of a sound-deadening insert (1) in a silencer of an exhaust-gas discharge system in an internal-combustion engine of a vehicle; said sound-deadening insert (1) comprising a flexible mattress (5) made up of continuous voluminized fibres (6) of sound-deadening material having a plurality of turns arranged coaxial to each other said fibres being wound around a winding axis (A) and having one or more needled lines (2) of compacted fibres (6) that extend without interruption along the mattress (5) transverse to said fibres (6) and are designed to keep the fibres (6) locally joined together so as to prevent the mattress (5) from opening up.

* * * * *